US011154744B2

(12) United States Patent
Henniger

(10) Patent No.: US 11,154,744 B2
(45) Date of Patent: Oct. 26, 2021

(54) LOADABLE DUMBBELL ASSEMBLY AND BUMPER WEIGHTS FOR A LOADABLE DUMBBELL

(71) Applicant: Coulter Ventures, LLC, Columbus, OH (US)

(72) Inventor: William Henniger, Columbus, OH (US)

(73) Assignee: Coulter Ventures, LLC, Columbus, OH (US)

( * ) Notice: Subject to any disclaimer, the term of this patent is extended or adjusted under 35 U.S.C. 154(b) by 0 days.

(21) Appl. No.: 15/934,989

(22) Filed: Mar. 24, 2018

(65) Prior Publication Data

US 2018/0272175 A1 Sep. 27, 2018

Related U.S. Application Data

(60) Provisional application No. 62/475,987, filed on Mar. 24, 2017.

(51) Int. Cl.
*A63B 21/072* (2006.01)
*A63B 21/06* (2006.01)

(52) U.S. Cl.
CPC ..... *A63B 21/0726* (2013.01); *A63B 21/0607* (2013.01); *A63B 21/0728* (2013.01); *A63B 21/0608* (2013.01)

(58) Field of Classification Search
CPC ..... A63B 21/072–0728; A63B 21/06–0608; A63B 21/0726; A63B 21/0607; A63B 21/0728; A63B 21/0608
See application file for complete search history.

(56) References Cited

U.S. PATENT DOCUMENTS

| | | | | | |
|---|---|---|---|---|---|
| 2,676,802 | A * | 4/1954 | O'Brien | A63B 21/0724 | 482/106 |
| 3,022,073 | A * | 2/1962 | Miller | A63B 21/0728 | 482/106 |
| 4,351,526 | A * | 9/1982 | Schwartz | A63B 21/0726 | 482/105 |
| 5,484,367 | A * | 1/1996 | Martinez | A63B 21/0728 | 482/107 |
| 5,911,651 | A * | 6/1999 | Liu | A63B 21/0602 | 482/107 |
| 6,224,520 | B1 * | 5/2001 | Hsu | A63B 21/0603 | 482/107 |
| 6,336,894 | B1 * | 1/2002 | Kestila | A63B 21/072 | 482/108 |
| 6,770,016 | B1 * | 8/2004 | Anderson | A63B 21/0724 | 482/106 |
| 6,875,161 | B1 * | 4/2005 | Brice | A63B 21/0724 | 482/107 |
| D574,450 | S * | 8/2008 | Januszek | A63B 21/072 | D21/681 |

(Continued)

*Primary Examiner* — Nyca T Nguyen
(74) *Attorney, Agent, or Firm* — The Watson IP Group, PLC; Jovan N. Jovanovic

(57) ABSTRACT

A combination loadable dumbbell and bumper weight including a loadable dumbbell having a central shaft and opposing sleeves. At least one bumper weight having a core and a bumper portion surrounding the core is provided. The core has a central bore. The at least one bumper weight can be slid over one of the opposing sleeves so that the opposing sleeve is directed into the central bore.

21 Claims, 6 Drawing Sheets

(56) References Cited

U.S. PATENT DOCUMENTS 7,491,156 B1* 2/2009 GaoYong ..... A63B 21/0724 482/106
2001/0049324 A1* 12/2001 Wallace ..... A63B 21/072 482/106
2003/0096683 A1* 5/2003 Fenelon ..... A63B 21/0601 482/107
2003/0232705 A1* 12/2003 Harms ..... A63B 21/0728 482/108
2006/0105891 A1* 5/2006 Cappellini ..... A63B 21/0724 482/107
2006/0172871 A1* 8/2006 Cao ..... A63B 21/075 482/106
2007/0197352 A1* 8/2007 Charniga ..... A63B 21/06 482/93
2007/0197354 A1* 8/2007 Januszek ..... A63B 21/0728 482/107
2007/0243978 A1* 10/2007 Allen, Jr. ..... A63B 23/0211 482/108
2008/0220952 A1* 9/2008 Yang ..... A63B 21/072 482/107
2009/0118105 A1* 5/2009 Schiff ..... A63B 21/0728 482/107
2009/0192025 A1* 7/2009 Minerva ..... A63B 21/0726 482/93
2009/0239719 A1* 9/2009 Patti ..... A63B 21/0726 482/107
2009/0258766 A1* 10/2009 Patti ..... A63B 21/0726 482/107
2009/0270233 A1* 10/2009 Cao ..... A63B 21/0726 482/108
2010/0075816 A1* 3/2010 Anderson ..... A63B 21/0728 482/107
2010/0190618 A1* 7/2010 Chen ..... A63B 21/0728 482/108
2010/0323856 A1* 12/2010 Svenberg ..... A63B 21/0728 482/108
2011/0021327 A1* 1/2011 Lien ..... A63B 21/0728 482/107
2011/0045956 A1* 2/2011 Colledge ..... A63B 21/0728 482/107
2011/0152042 A1* 6/2011 Anderson ..... A63B 21/072 482/108
2012/0115689 A1* 5/2012 Dalebout ..... A63B 21/0726 482/107
2012/0172182 A1* 7/2012 Leier ..... A63B 21/072 482/108
2012/0289386 A1* 11/2012 Yu ..... A63B 21/075 482/107
2012/0322630 A1* 12/2012 Hood ..... A63B 21/023 482/106
2013/0012369 A1* 1/2013 Prest ..... A63B 22/20 482/132
2013/0040788 A1* 2/2013 Booker ..... A63B 21/075 482/106
2013/0109545 A1* 5/2013 Chen ..... A63B 21/0724 482/107
2013/0150217 A1* 6/2013 Tang ..... A63B 21/0726 482/108
2013/0196830 A1* 8/2013 Pfitzer ..... A63B 21/0602 482/110
2013/0288862 A1* 10/2013 Lien ..... A63B 21/0726 482/108
2014/0031177 A1* 1/2014 Wang ..... A63B 21/075 482/107
2014/0162850 A1* 6/2014 Chen ..... A63B 21/0728 482/104
2014/0162855 A1* 6/2014 Beckman ..... A63B 21/0728 482/139
2014/0162856 A1* 6/2014 Kramer ..... A63B 21/0726 482/139
2014/0200119 A1* 7/2014 Sides, Jr. ..... A63B 21/0618 482/106
2014/0221174 A1* 8/2014 Lin ..... A63B 21/0724 482/107
2014/0243166 A1* 8/2014 Lister ..... A63B 21/0601 482/93
2016/0030797 A1* 2/2016 Erickson ..... A63B 21/068 482/132
2016/0051856 A1* 2/2016 Breitkreutz ..... A63B 21/0603 482/93
2016/0082304 A1* 3/2016 Behle ..... A63B 21/0728 482/107
2016/0166873 A1* 6/2016 Liu ..... A63B 21/0726 482/107
2016/0184623 A1* 6/2016 Moran ..... A63B 21/075 482/8
2017/0080274 A1* 3/2017 Dickerson ..... A63B 21/4035
2017/0095688 A1* 4/2017 Stilson ..... A63B 21/0728
2017/0189735 A1* 7/2017 Buikema ..... A63B 21/4035
2017/0259107 A1* 9/2017 Shalvi ..... A63B 21/0726

* cited by examiner

LOADABLE DUMBBELL ASSEMBLY AND BUMPER WEIGHTS FOR A LOADABLE DUMBBELL

CROSS-REFERENCE TO RELATED APPLICATION

This application claims priority from U.S. Pat. App. Ser. No. 62/475,987 filed Mar. 24, 2017, entitled "Bumper Weights For A Loadable Dumbbell", the entire disclosure of which is hereby incorporated by reference in its entirety.

BACKGROUND OF THE DISCLOSURE

1. Field of the Disclosure

The disclosure relates in general to weightlifting, and more particularly, to a bumper weight for a loadable dumbbell.

2. Background Art

The use of dumbbells is known in the art. Dumbbells generally are graspable by a single arm to execute different exercises wherein the weights are lifted. Loaded dumbbells are known in the art. Among others, one such loadable dumbbell is provided by Rogue Fitness, of Columbus, Ohio, under the trademarks DB-IO and DB-15. While these types of loadable dumbbells are configured to receive weights, problematically, it has been difficult to provide for larger and heavier weights, while maintaining such a form factor.

Furthermore, such difficulties have been exacerbated by the desire to have bumper plates and bumper weights utilizable with loadable dumbbells.

SUMMARY OF THE DISCLOSURE

The disclosure is directed to a bumper weight for a loadable dumbbell. The combination includes a loadable dumbbell and a plurality of bumper weights. The loadable dumbbell includes a central shaft and opposing first and second sleeves. The bumper weight includes a core and a bumper portion annularly outboard of the core.

In an aspect of the disclosure, the disclosure is directed to a combination loadable dumbbell and bumper weight comprising a loadable dumbbell and at least one bumper weight. The loadable dumbbell has a central shaft and opposing sleeves defining a first sleeve and a second sleeve opposite the first sleeve. The at least one bumper plate has a core and a bumper portion surrounding the core, the core having a central bore. The at least one bumper weight can be slid over one of the opposing sleeves so that the opposing sleeve is directed into the central bore and a portion of the opposing sleeve extends radially outwardly beyond the outer end of the central bore.

In some configurations, the first sleeve includes an inner stop at an inner end thereof and a weight portion. The inner stop includes an inner face, an outer face and a perimeter face. The perimeter face defines a perimeter face diameter. The weight portion comprises an elongated member defining a weight portion diameter. The weight portion diameter is smaller than the perimeter face diameter; and The core of the at least one bumper weight further includes an inner stop bore portion and an outer sleeve portion, with a lip defined therebetween. The inner stop bore portion corresponds to the perimeter face and the outer sleeve portion corresponds to the weight portion diameter so that the core of the at least one bumper weight can be slid over the perimeter portion of the first sleeve.

In some configurations, the first sleeve and the second sleeve are substantially mirror images of each other.

In some configurations, the first sleeve further includes an inner face and the core of the bumper weight further includes an inner end. The inner face and the inner end lie in the same plane.

In some configurations, the weight portion of the first sleeve is longer than the at least one bumper weight so that an outer end of the weight portion of the first sleeve extends beyond an outer end of the core of the bumper weight.

In some configurations, the bumper weight has an inner component and an outer component coupled to the inner component. The inner component having an inner flange and the outer component having an outer flange, with a mid portion therebetween. The inner flange and the outer flange extend radially outwardly farther than the mid portion.

In some configurations, the core comprises a metal member and the bumper portion comprises an elastic member.

In another aspect of the disclosure, the disclosure is directed to a bumper weight suitable for use with a loadable dumbbell. In such a configuration, the bumper weight has a core and a bumper portion. The core has an inner end and an outer end. A central bore extends therethrough. The central bore has an outer sleeve portion and an inner stop bore portion. The inner stop bore portion extends axially inwardly from the inner end of the core and has an inner stop bore diameter and the outer sleeve portion extends axially inwardly from the outer end of the core to the inner stop bore portion and has an outer sleeve diameter that is constant along its entire length. The inner stop bore portion and the outer sleeve portion are concentric. The outer sleeve diameter is smaller than the inner stop bore diameter, with a lip spanning therebetween. The core is configured to receive an end portion of the loadable dumbbell from the inner end, through the inner stop bore portion and the outer sleeve portion, and exiting at the outer end. The bumper portion has a central bore configured to receive the core, and an outer surface.

In some configurations, the sleeve portion has a sleeve length and the inner stop bore portion has an inner stop bore length. The sleeve length is multiple times larger than the inner stop bore length.

In some configurations, the lip defines a plane that is substantially perpendicular to a longitudinal axis of the central bore.

In some configurations, the core has an outward surface. The outward surface has an inner flange at an inner end thereof and an outer flange at an outer end thereof, with a mid portion extending therebetween. The inner flange and the outer flange extend radially outwardly farther than the mid portion.

In some configurations, the outer surface of the bumper weight defines a substantially uniform diameter, to, in turn, define a cylindrical configuration. In some configurations, the inner end and the outer end define substantially parallel planes.

In some configurations, the bumper weight include an inner component and an outer component coupled together.

In some configurations, the core comprises a metal member, with the bumper portion comprising an elastic member.

In another aspect of the disclosure, the disclosure is directed to a combination loadable dumbbell and bumper weight comprising a loadable dumbbell, a first bumper weight and a second bumper weight. The loadable dumbbell has a central shaft and opposing sleeves defining a first sleeve and a second sleeve opposite the first sleeve. The first bumper weight has a first core and a first bumper portion surrounding the first core. The first core has a first central bore extending over the first sleeve. The second bumper weight has a second core and a second bumper portion surrounding the second core. The second core has a second central bore extending over the second sleeve. Each of the first sleeve and the second sleeve have an inner stop at an inner end thereof and a weight portion. The inner stop including an inner face, an outer face and a perimeter face. The perimeter face defines a perimeter face diameter. The weight portion comprises an elongated member defining a weight portion diameter, with the weight portion diameter being smaller than the perimeter face diameter. Each of the first core of the first bumper and the second core of the second bumper having an inner stop bore portion and an outer sleeve portion, with a lip defined therebetween. The inner stop bore portion corresponding to the perimeter face and the outer sleeve portion corresponding to the weight portion diameter so that the core of the at least one bumper weight can be slid over the perimeter portion of the first sleeve.

In some configurations, the first inner face of the first sleeve is coplanar with a first inner end of the first core of the first bumper weight, and the second inner face of the second sleeve is coplanar with a second inner end of the second core of the second bumper weight.

In some configurations, the first sleeve includes an outer end and the second sleeve includes an outer end. The outer end of the first sleeve extends beyond an outer end of the first core of the first bumper weight. The outer end of the second sleeve extends beyond an outer end of the second core of the second bumper weight.

BRIEF DESCRIPTION OF THE DRAWINGS

The disclosure will now be described with reference to the drawings wherein.

DETAILED DESCRIPTION OF THE DISCLOSURE

Figure 1:
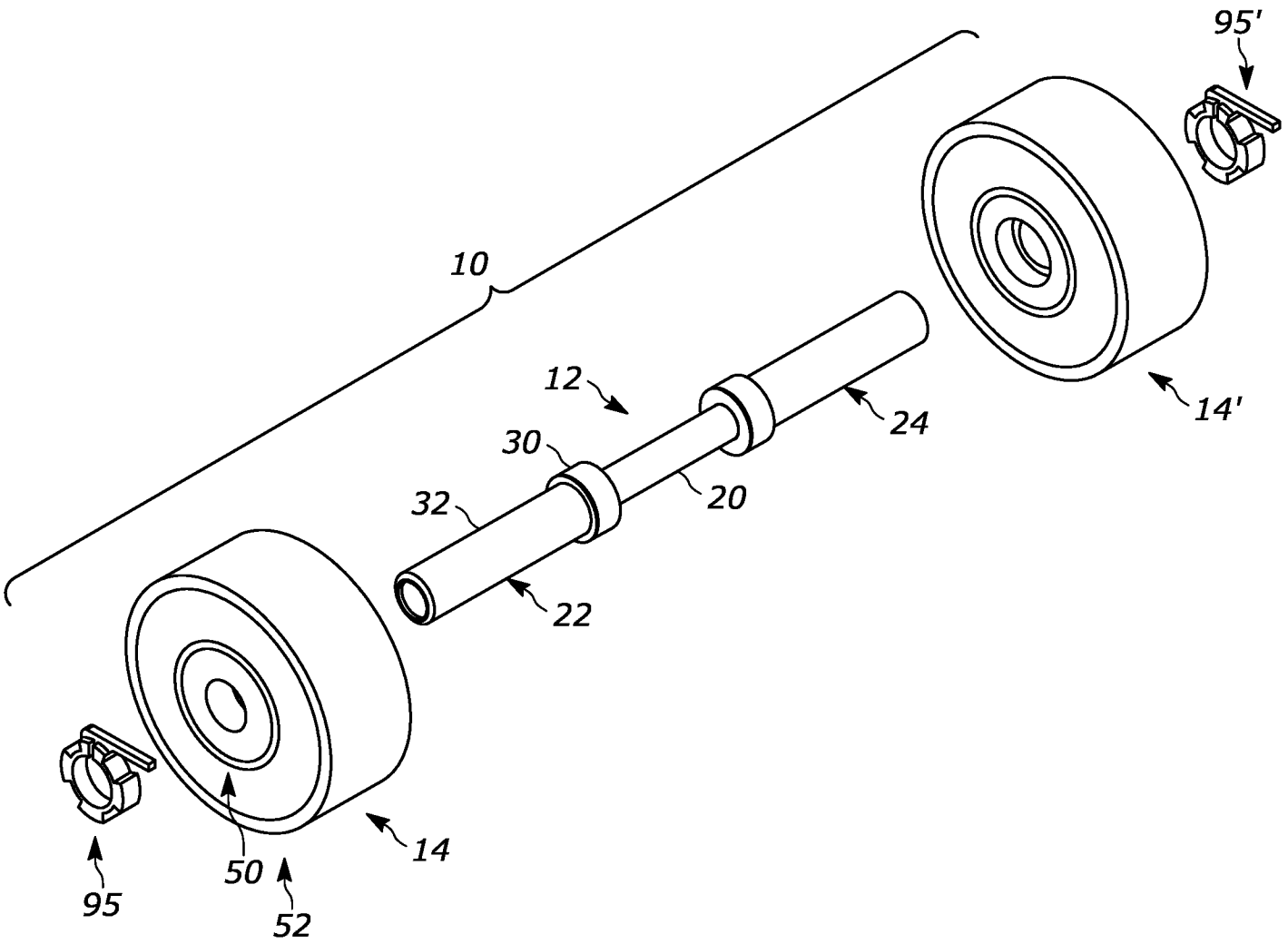
FIG. 1 of the drawings is an exploded view of a loadable dumbbell assembly of the present disclosure, showing the dumbbell, a pair of bumper weights and locking collars.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
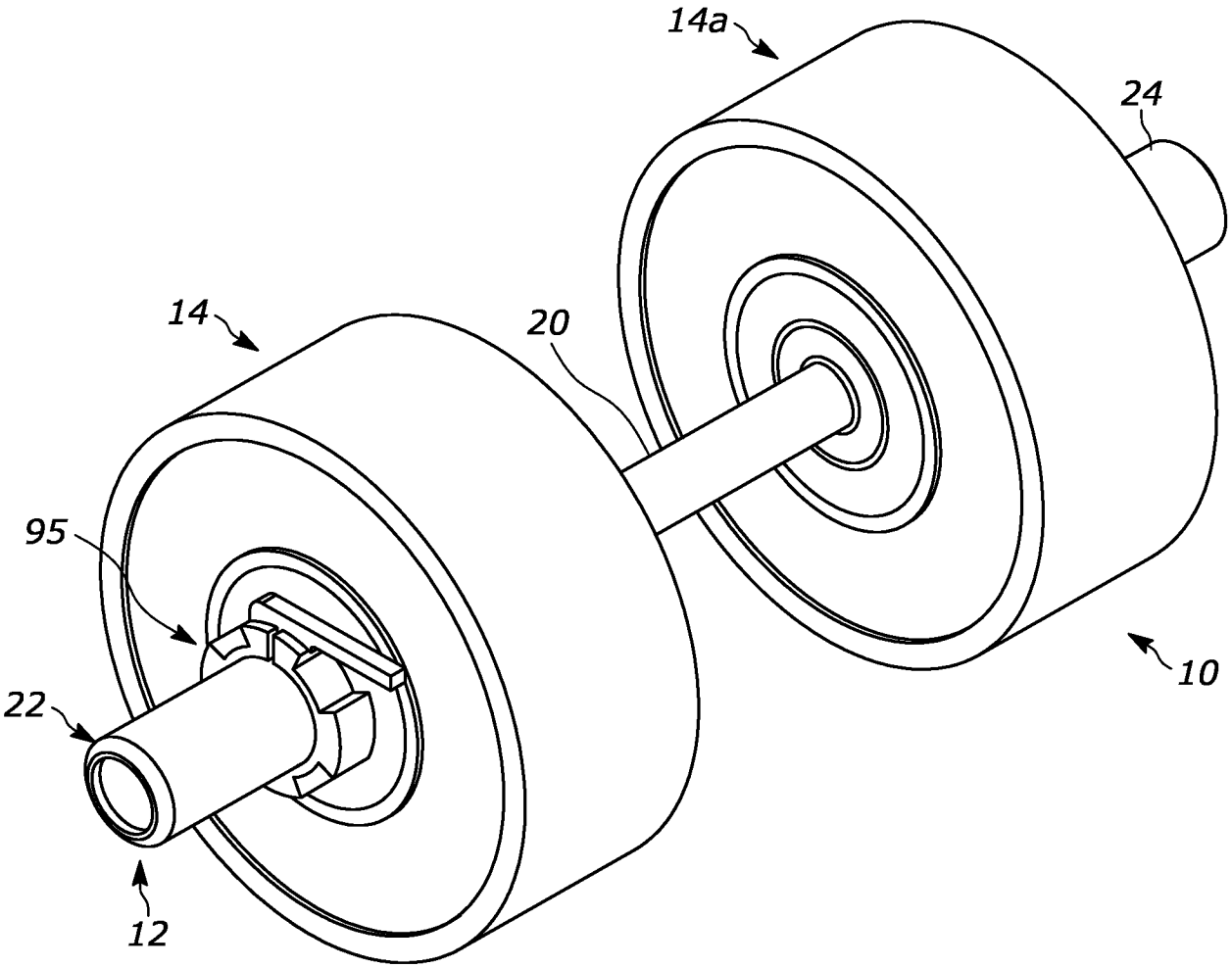
FIG. 2 of the drawings is a perspective view of the loadable dumbbell assembly of the present disclosure.

Referring now to the drawings and in particular to FIGS. 1 and 2, the bumper weight for a loadable dumbbell is shown generally at 14. A pair of bumper weights 14, 14*a* are attachable to a loadable dumbbell, such as a loadable dumbbell 12 similar to that which is sold by Rogue Fitness of Columbus, Ohio under the name DB-10 and/or DB-15 to define a loadable bumper assembly. Such a loadable dumbbell typically includes a central shaft 20, a first sleeve 22 and a second sleeve 24. The first and second sleeves are generally mirror images of each other, and, as such, the first sleeve will be explained with the understanding that the second sleeve is a substantially identical mirror image thereof.

Figure 3:
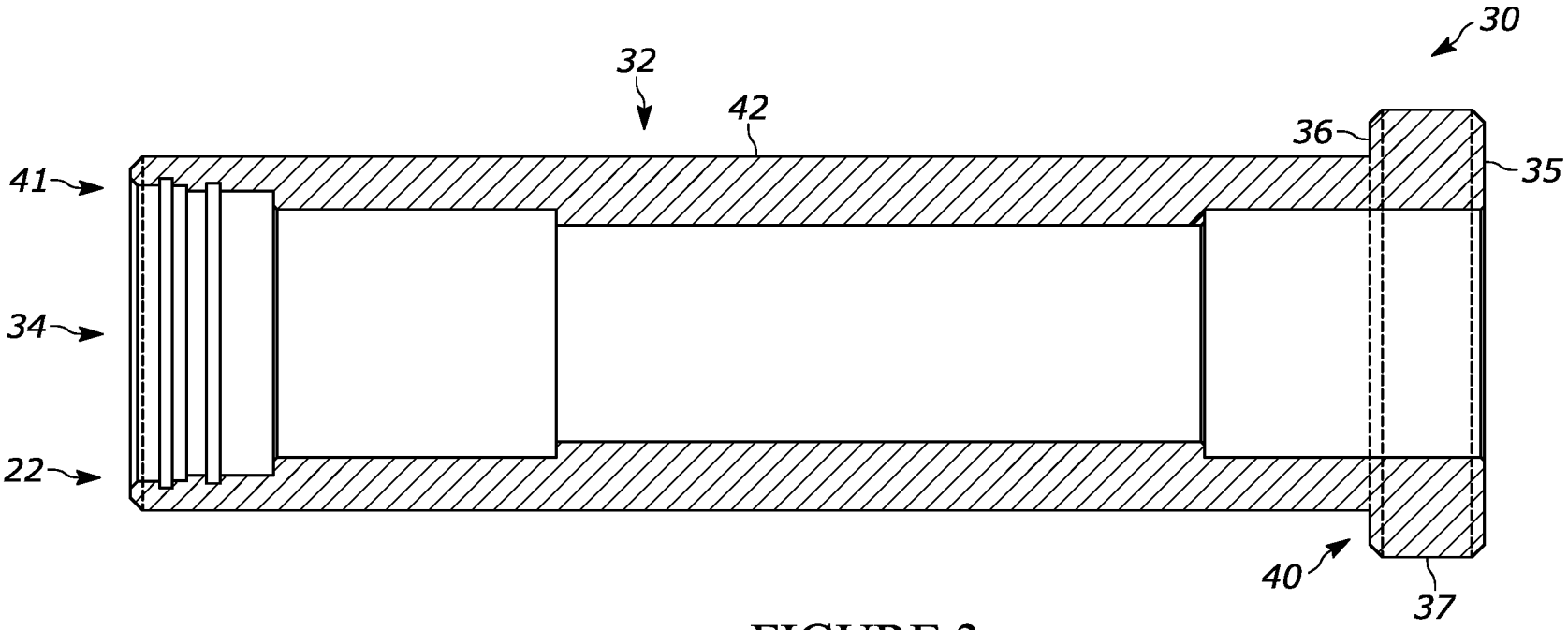
FIG. 3 of the drawings is a cross-sectional view of a sleeve of the loadable dumbbell assembly of the present disclosure.
Figure 4:
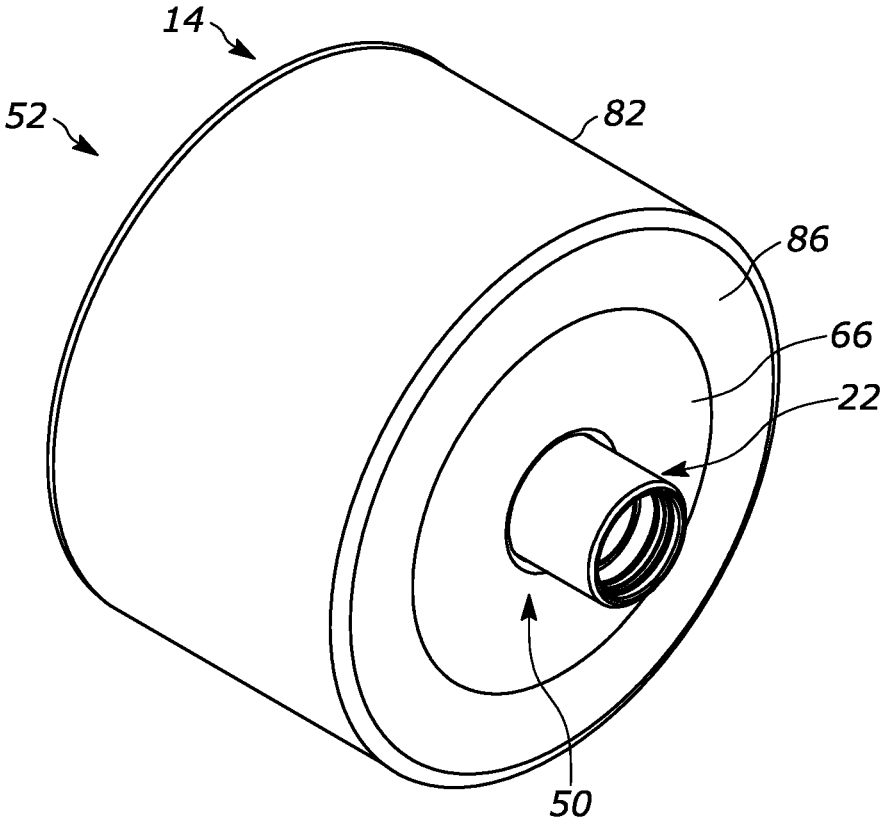
FIG. 4 of the drawings is a perspective view of a bumper weight along with a sleeve of the loadable dumbbell assembly of the present disclosure.
Figure 5:
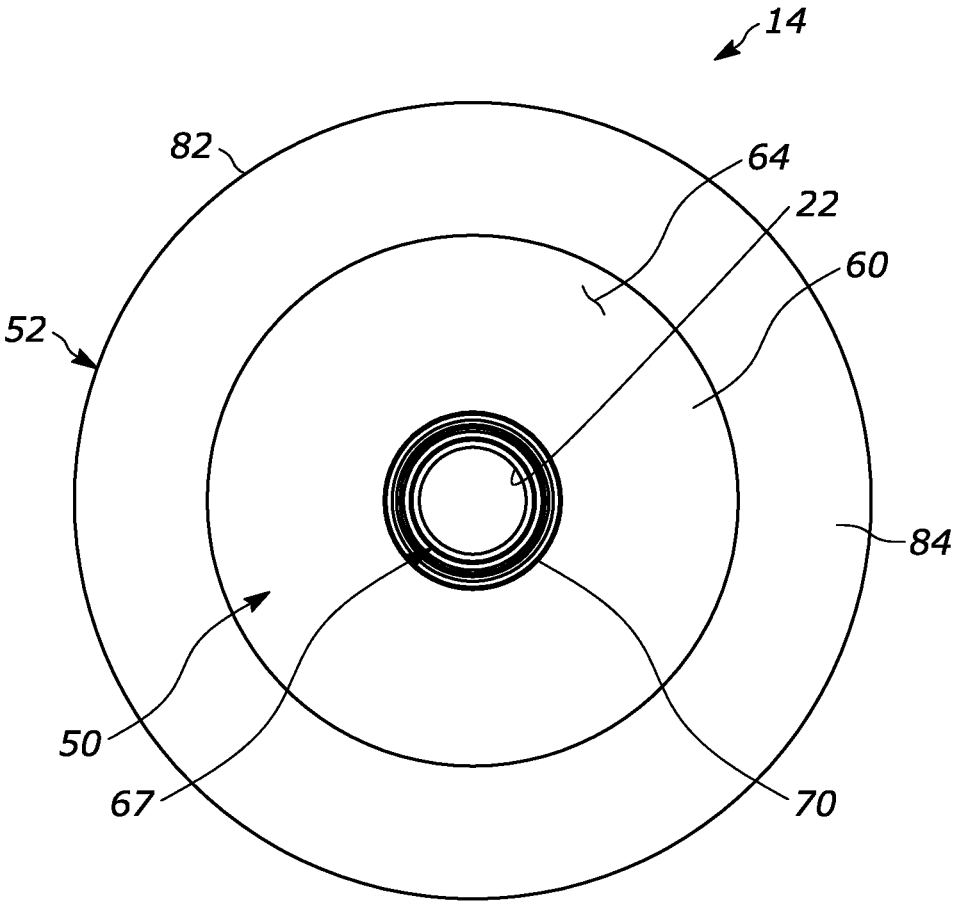
FIG. 5 of the drawings is an inner side elevational view of the bumper weight along with the sleeve of the loadable dumbbell assembly of the present disclosure.
Figure 6:
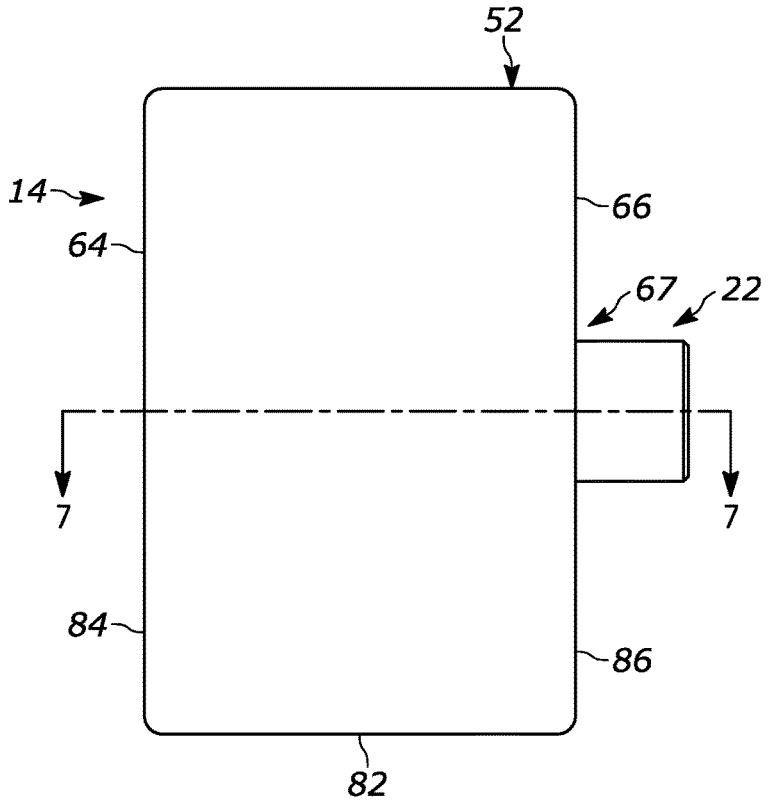
FIG. 6 of the drawings is a side elevational view of the bumper weight along with the sleeve of the loadable dumbbell assembly of the present disclosure.
Figure 7:
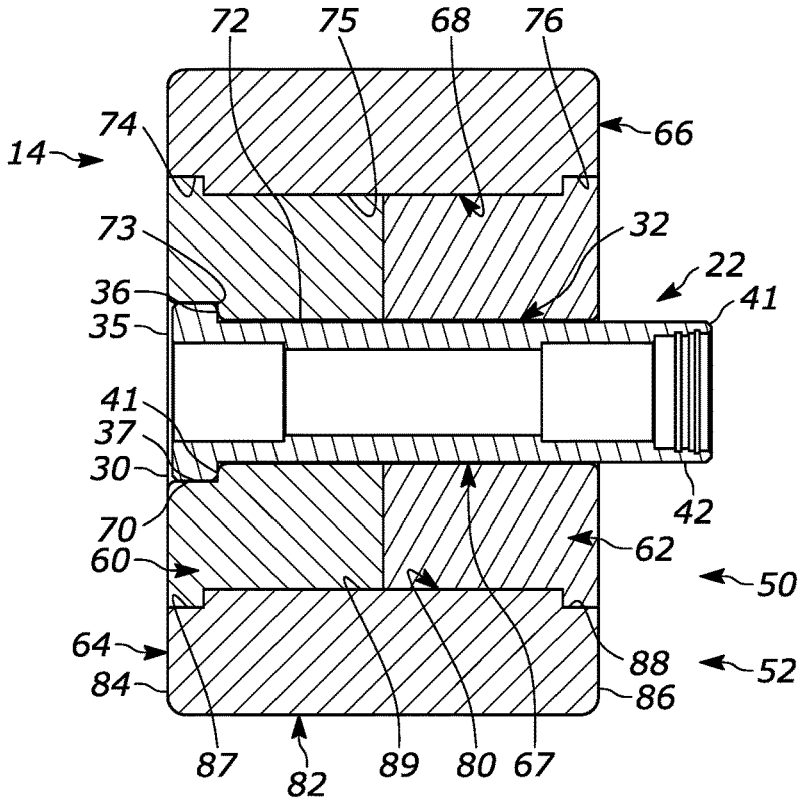
FIG. 7 of the drawings is a cross-sectional view of the bumper weight along with the sleeve of the loadable dumbbell assembly of the present disclosure, taken generally about lines 7-7 of FIG. 6.

The first sleeve 22 is shown in greater detail in FIG. 3 as including inner stop 30, weight portion 32 and central bore 34. The inner stop includes inner face 35, outer face 36 and perimeter face 37 spanning therebetween. The weight portion 32 extends outwardly from the outer face 36 of the inner stop and includes inner end 40, outer end 41 and outer sleeve surface 42. The inner stop 30 and the weight portion 32 are substantially concentric, with the diameter of the inner stop being larger than that of the weight portion, and with the outer face 36 being substantially perpendicular to the tangent of the outer sleeve surface of the weight portion 32. In the configuration shown, the outer sleeve surface 42 and the perimeter face 37 are substantially concentric surfaces. In the configuration shown, the sleeve length is approximately 7.5 inches. With the perimeter face being approximately 0.635 inches.

The central bore has a number of different regions all of which are configured to receive the central shaft 20 and, to be coupled thereto through a series of bearings, clips and the like. Typically, the sleeves 22, 24 are rotatably mounted to the central shaft, and can freely spin relative to the central shaft. It will be understood that a number of configurations are contemplated for the central bore and a number of different coupling manners to the central shaft are contemplated.

The bumper weight 14, 14*a* is shown in FIG. 1, and bumper weight 14 is shown in greater detail in FIGS. 4 through 7 as comprising core 50 and bumper portion 52. The core 50 includes inner component 60, outer component 62 defining an inner end 64, outer end 66, a central bore 67 and an outward surface 68. The bumper weight is contemplated as being a metal component of sufficient weight. In this case, it is desirable to have a 45 lb weight which is positionable onto the sleeve leaving about 1.5 inches of sleeve so that a locking collar, such as locking collar 95, 95' can be coupled to the sleeve to lock the weight thereto.

The inner and outer components are generally mated to each other through fasteners, or the like. In other configurations, the two may be welded or otherwise joined to each other. Dimensionally, for the 45 lb weight, it is contemplated that the diameter of the overall bumper weight is 9 inches, with a width of 6 inches wherein the core 50 has a diameter of 5.5 inches taken about the mid portion 75 and 6 inches taken about the inner and outer flanges 74, 76.

The central bore 67 of the core 50 includes inner stop bore portion 70 which defines lip or flange 73, and outer sleeve bore portion 72. It will be understood that when the bumper weight 14 is slid over the sleeve 22, the inner stop extends into the inner stop bore portion, and is precluded from further inward movement by the lip/flange 73. At the same time, the outer sleeve bore portion 72 extends over the outer sleeve surface 42 of the weight portion 32.

It will be understood that the outer sleeve bore portion 72 has a sleeve length and the inner stop bore portion 70 has an inner stop bore length. The sleeve length is multiple times larger than the inner stop bore length. Additionally, the lip 73 defines a plane that is substantially perpendicular to a longitudinal axis of the central bore 67, that is, the bore 67 that extends along the length of the central shaft 20. Furthermore, the outer surface of the bumper weight 14, defines a substantially uniform diameter so as to define a cylindrical configuration. Furthermore, the inner end 64 and the outer end 66 define substantially parallel planes.

The outward surface 68 of the core 50 includes inner flange 74, outer flange 76 and mid portion 75 positioned therebetween. The inner and outer flanges are positioned at the inner end and the outer end of the core, respectively, and have a diameter that is greater than the mid portion 75, therebetween. That is, the inner flange and the outer flange extend radially outwardly farther than the mid portion.

The bumper portion 52 includes central bore 80, outer surface 82, inner end 84 and outer end 86. The inner and outer ends of the bumper portion correspond to that of the core so that the thickness of the bumper weight is substantially uniform between the core and the bumper portion. The inner recess 87 corresponds to the inner flange 74, the outer recess 88 corresponds to the outer flange 76 and the mid region 89 corresponds to the mid portion 75. Thus, the interfacing between the recesses and the flanges maintains the core 50 and the bumper portion 52 is engagement. The bumper comprises an elastic material, such as a polymer based material having elasticity.

It will be understood that the assembly of the bumper weight can be accomplished by providing the bumper portion, the inner component 60 and the outer component 62 of the core 50. Once provided, the inner component can be inserted into the bumper portion from the inner end, and the outer component can be inserted into the bumper portion from the outer end. The inner and outer components can then be coupled to each other.

In other configurations, such as, if the core is from a single component, the bumper portion can be stretched with the core being slid into the central bore of the bumper portion. When released, the mid region 89 of the bumper portion is captured between the inner flange 74 and the outer flange 76 of the core 50.

In operation, and as explained above, the bumper weight 14 can be slid over the first and second sleeves. Once slid over the sleeves, the bumper weight is directed further along the sleeve until the inner stop bore portion 70 of the core 50 overlies the perimeter face 37 of the inner stop of the sleeve, with the lip/flange 73 resting against the outer face 36 of the sleeve. At such time, the inner end 64 of the core 50 is generally flush with the inner face 35 of the inner stop 30 of the sleeve. That is, the inner face of the sleeve, and the inner end of the core of the bumper weight lie in the same plane.

It will be understood that even with the 45 lb weight, about 1.5 inches of the weight portion of the sleeve remains visible beyond the outer end of the core 50. As will be understood, this space is adequate to receive a locking collar or the like.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A combination loadable dumbbell and bumper weight comprising:

a loadable dumbbell having a central shaft and opposing sleeves defining a first sleeve and a second sleeve opposite the first sleeve, each of the first sleeve and second sleeve having a sleeve central bore that receives a portion of the central shaft;

at least one bumper weight having a core and a bumper portion surrounding the core, the core having a central bore having an inner end and an outer end, and the bumper portion having a bumper central bore extending completely through the bumper portion, the core being received in the bumper central bore of the bumper portion;

wherein the at least one bumper weight is configured to be slid over one of the first and second sleeves so that the respective first or second sleeve is directed into the central bore and a portion of the respective first or second sleeve extends radially outwardly beyond the outer end of the central bore.

2. The combination of claim 1 wherein:

the first sleeve includes an inner stop at an inner end thereof and a weight portion, the inner stop including an inner face, an outer face and a perimeter face, the perimeter face defining a perimeter face diameter, the weight portion comprising an elongated member defining a weight portion diameter, with the weight portion diameter being smaller than the perimeter face diameter; and the core of the at least one bumper weight further includes an inner stop bore portion and an outer sleeve portion, with a lip defined therebetween, the inner stop bore portion corresponding to the perimeter face and the outer sleeve portion corresponding to the weight portion diameter so that the core of the at least one bumper weight is configured to be slid over the perimeter portion of the first sleeve.

3. The combination of claim 2 wherein the first sleeve and the second sleeve are substantially mirror images of each other.

4. The combination of claim 2 wherein the first sleeve further includes an inner face and the core of the bumper weight further includes an inner end, wherein the inner face and the inner end lie in the same plane.

5. The combination of claim 2 wherein the weight portion of the first sleeve is longer than the at least one bumper weight so that an outer end of the weight portion of the first sleeve extends beyond an outer end of the core of the bumper weight.

6. The combination of claim 2 wherein the bumper weight has an inner component and an outer component coupled to the inner component, the inner component having an inner flange and the outer component having an outer flange, with a mid portion therebetween, wherein the inner flange and the outer flange extend radially outwardly farther than the mid portion.

7. The combination of claim 2 wherein the core comprises a metal member and the bumper portion comprises an elastic member.

8. A bumper weight suitable for use with a loadable dumbbell, the bumper weight comprising:

a core having an inner end and an outer end, a central bore extending therethrough, the central bore having an outer sleeve portion and an inner stop bore portion, wherein the inner stop bore portion extends axially inwardly from the inner end of the core and has an inner stop bore diameter and the outer sleeve portion extends axially inwardly from the outer end of the core to the inner stop bore portion and has an outer sleeve diameter that is constant along its entire length, the inner stop bore portion and the outer sleeve portion being concentric, with the outer sleeve diameter being smaller than the inner stop bore diameter, with a lip spanning therebetween, wherein the core is configured to receive an end portion of the loadable dumbbell from the inner end, through the inner stop bore portion and the outer sleeve portion, and exiting at the outer end; and a bumper portion having a central bore extending completely through the bumper portion and configured to receive the core, and an outer surface.

9. The bumper weight of claim 8 wherein the sleeve portion has a sleeve length and the inner stop bore portion has an inner stop bore length, wherein the sleeve length is at least two times larger than the inner stop bore length.

10. The bumper weight of claim 8 wherein the lip defines a plane that is substantially perpendicular to a longitudinal axis of the central bore.

11. The bumper weight of claim 8 wherein the core has an outward surface, the outward surface having an inner flange at an inner end thereof and an outer flange at an outer end thereof, with a mid portion extending therebetween, wherein the inner flange and the outer flange extend radially outwardly farther than the mid portion.

12. The bumper weight of claim 8 wherein the outer surface of the bumper weight defines a substantially uniform diameter, to, in tum, define a cylindrical configuration.

13. The bumper weight of claim 8 wherein the inner end and the outer end define substantially parallel planes.

14. The bumper weight of claim 8 comprising an inner component and an outer component coupled together.

15. The bumper weight of claim 8 wherein the core comprises a metal member, with the bumper portion comprising an elastic member.

16. A combination loadable dumbbell and bumper weight comprising:

a loadable dumbbell having a central shaft and opposing sleeves defining a first sleeve and a second sleeve opposite the first sleeve;

a first bumper weight having a first bumper portion including a first central bore extending completely through the first bumper weight, and a first core received in the first central bore of the first bumper weight, the first core having a first central bore extending over the first sleeve;

a second bumper weight having a second bumper portion including a second central bore extending completely through the second bumper weight, and a second core received in the first central bore of the first bumper weight, the second core having a second central bore extending over the second sleeve;

each of the first sleeve and the second sleeve having an inner stop at an inner end thereof and a weight portion, the inner stop including an inner face, an outer face and a perimeter face, the perimeter face defining a perimeter face diameter, the weight portion comprising an elongated member defining a weight portion diameter, with the weight portion diameter being smaller than the perimeter face diameter; and each of the first core of the first bumper weight and the second core of the second bumper weight having an inner stop bore portion and an outer sleeve portion, with a lip defined therebetween, the inner stop bore portion corresponding to the perimeter face and the outer sleeve portion corresponding to the weight portion diameter so that the first core of the first bumper weight is configured to be slid over the perimeter face and the weight portion of the first sleeve and the second core of the second bumper weight is configured to be slid over the perimeter face and the weight portion of the second sleeve.

17. The combination of claim 16 wherein the inner face of the first sleeve is coplanar with a first inner end of the first core of the first bumper weight, and the inner face of the second sleeve is coplanar with a second inner end of the second core of the second bumper weight.

18. The combination of claim 17 wherein the first sleeve includes an outer end and the second sleeve includes an outer end, the outer end of the first sleeve extending beyond an outer end of the first core of the first bumper weight, and the outer end of the second sleeve extending beyond an outer end of the second core of the second bumper weight.

19. A combination loadable dumbbell and bumper weight comprising:

a loadable dumbbell having a central shaft and opposing sleeves defining a first sleeve and a second sleeve opposite the first sleeve;

at least one bumper weight having a core and a bumper portion surrounding the core, the core having a central bore;

wherein the at least one bumper weight is configured to be slid over one of the opposing sleeves so that the opposing sleeve is directed into the central bore;

the first sleeve includes an inner stop at an inner end thereof and a weight portion, the inner stop including an inner face, an outer face and a perimeter face, the perimeter face defining a perimeter face diameter, the weight portion comprising an elongated member defining a weight portion diameter, with the weight portion diameter being smaller than the perimeter face diameter;

the core of the at least one bumper weight further includes an inner stop bore portion and an outer sleeve portion, with a lip defined therebetween, the inner stop bore portion corresponding to the perimeter face and the outer sleeve portion corresponding to the weight portion diameter so that the core of the at least one bumper weight is configured to be slid over the perimeter portion of the first sleeve; and the at least one bumper weight has an inner component and an outer component coupled to the inner component, the inner component having an inner flange and the outer component having an outer flange, with a mid portion therebetween, wherein the inner flange and the outer flange extend radially outwardly farther than the mid portion.

20. A bumper weight suitable for use with a loadable dumbbell, the bumper weight comprising:

a core having an inner end and an outer end, a central bore extending therethrough, the central bore having an outer sleeve portion and an inner stop bore portion, wherein the inner stop bore portion has an inner stop bore diameter and the outer sleeve portion has an outer sleeve diameter, the inner stop bore portion and the outer sleeve portion being concentric, with the outer sleeve diameter being smaller than the inner stop bore diameter, with a lip spanning therebetween; and a bumper portion having a central bore configured to receive the core, and an outer surface;

wherein the core has an outward surface, the outward surface having an inner flange at an inner end thereof and an outer flange at an outer end thereof, with a mid portion extending therebetween, wherein the inner flange and the outer flange extend radially outwardly farther than the mid portion.

21. A combination loadable dumbbell and bumper weight comprising:

a loadable dumbbell having a central shaft and opposing sleeves defining a first sleeve and a second sleeve opposite the first sleeve, each of the first sleeve and second sleeve having a sleeve central bore that receives a portion of the central shaft;

at least one bumper weight having a core and a bumper portion surrounding the core, the core having a central bore and the bumper portion having a bumper central bore extending completely through the bumper portion, the core being received in the bumper central bore of the bumper portion;

wherein the at least one bumper weight is configured to be slid over one of the opposing sleeves so that the opposing sleeve is directed into the central bore;

the first sleeve includes an inner stop at an inner end thereof and a weight portion, the inner stop including an inner face, an outer face and a perimeter face, the perimeter face defining a perimeter face diameter, the weight portion comprising an elongated member defining a weight portion diameter, with the weight portion diameter being smaller than the perimeter face diameter; and the core of the at least one bumper weight further includes an inner stop bore portion and an outer sleeve portion, with a lip defined therebetween, the inner stop bore portion corresponding to the perimeter face and the outer sleeve portion corresponding to the weight portion diameter so that the core of the at least one bumper weight is configured to be slid over the perimeter portion of the first sleeve.

* * * * *